US007739810B2

(12) United States Patent
Luedecke et al.

(10) Patent No.: US 7,739,810 B2
(45) Date of Patent: Jun. 22, 2010

(54) ARTICLE OF FOOTWEAR FOR CONTACT SPORTS

(75) Inventors: Tom Luedecke, Portland, OR (US); Stann Sheperd, Santa Cruz, CA (US)

(73) Assignee: Nike, Inc., Beaverton, OR (US)

( * ) Notice: Subject to any disclaimer, the term of this patent is extended or adjusted under 35 U.S.C. 154(b) by 746 days.

(21) Appl. No.: 11/566,197

(22) Filed: Dec. 1, 2006

(65) Prior Publication Data

US 2008/0127520 A1 Jun. 5, 2008

(51) Int. Cl.
*A43B 5/00* (2006.01)

(52) U.S. Cl. ..... 36/114; 36/106; 36/9 R; 36/71

(58) Field of Classification Search ..... 36/9 R, 36/71, 114, 115, 106
See application file for complete search history.

(56) References Cited

U.S. PATENT DOCUMENTS

| | | | | | |
|---|---|---|---|---|---|
| 2,332,252 | A | | 10/1943 | Payne | |
| 2,884,646 | A | * | 5/1959 | Alber | 2/232 |
| 2,954,617 | A | | 10/1960 | Yamaguchi | |
| 3,515,136 | A | | 6/1970 | Baker | |
| 3,667,140 | A | * | 6/1972 | Hunderford | 36/4 |
| 3,949,493 | A | | 4/1976 | Rhee | |
| 4,008,531 | A | * | 2/1977 | Schonbrun et al. | 36/106 |
| 4,051,613 | A | * | 10/1977 | Collins | 36/114 |
| 4,168,584 | A | * | 9/1979 | Wren et al. | 36/2 R |
| 4,361,912 | A | * | 12/1982 | Arthur | 2/18 |
| 4,361,970 | A | * | 12/1982 | Wren et al. | 36/106 |
| 4,397,105 | A | * | 8/1983 | Richardson | 36/106 |
| 4,547,981 | A | * | 10/1985 | Thais et al. | 36/89 |
| 4,651,354 | A | * | 3/1987 | Petrey | 2/239 |
| 4,726,126 | A | * | 2/1988 | Bernhard | 36/89 |
| 4,769,854 | A | | 9/1988 | Williams | |
| 4,972,609 | A | | 11/1990 | Oh et al. | |
| 5,092,347 | A | * | 3/1992 | Shaffer et al. | 128/892 |
| 5,185,000 | A | * | 2/1993 | Brandt et al. | 602/63 |
| 5,205,071 | A | | 4/1993 | Hergenroeder | |
| 5,211,672 | A | * | 5/1993 | Andujar | 36/106 |
| D357,345 | S | | 4/1995 | Cheatwood et al. | |
| 5,475,935 | A | | 12/1995 | Frost | |
| 5,509,217 | A | | 4/1996 | Condini | |
| 5,774,898 | A | * | 7/1998 | Malpee | 2/239 |
| 5,925,010 | A | | 7/1999 | Caprio, Jr. | |
| 6,412,114 | B1 | | 7/2002 | Carlin | |
| 6,470,600 | B1 | | 10/2002 | Louie | |
| 2003/0167548 | A1 | | 9/2003 | LaShoto et al. | |
| 2006/0137224 | A1 | * | 6/2006 | Song | 36/72 R |
| 2006/0196078 | A1 | | 9/2006 | Terlizzi et al. | |

FOREIGN PATENT DOCUMENTS

| | | | |
|---|---|---|---|
| WO | WO 2005000049 | A2 * | 1/2005 |

* cited by examiner

*Primary Examiner*—Marie Patterson
(74) *Attorney, Agent, or Firm*—Plumsea Law Group, LLC

(57) ABSTRACT

An article of footwear for contact sports is disclosed. The article of footwear also includes pads disposed along its medial and lateral sides, including pads associated with the malleolus. Additionally holes along the toes, the bottom, and at the heel allow for increased contact of the user's foot with the ground, allowing greater feel and balance.

31 Claims, 6 Drawing Sheets

ARTICLE OF FOOTWEAR FOR CONTACT SPORTS

BACKGROUND OF THE INVENTION

1. Field of the Invention

The present invention relates generally to footwear, and in particular an article of footwear for contact sports.

2. Description of Related Art

Articles of footwear for contact sports, and in particular articles of footwear with multiple openings intended for use in martial arts or other contact sports have been previously proposed.

Song (U.S. patent number 20060317224) teaches a foot protection device adapted to protect feet when training and playing fighting games. The device includes an opening configured for insertion of the foot; an anterior hole disposed along the bottom of the device and configured to be disposed against the ball of the foot; a posterior hole configured for insertion of the heel; and toe holes configured to receive toes.

Song further teaches an article of footwear that includes an instep protective cover, disposed along the instep region and an ankle protective cover, disposed along the ankle portion. In the Song device, the ankle protective cover is associated with the instep protective cover. The ankle protective cover includes a coupling part, which is a portion that is attached directly to the exterior cover of the device, and a flap that extends from the coupling part. The flap may be disposed adjacent to the instep protective cover.

Andujar (U.S. Pat. No. 5,211,672) teaches a protective shoe for use in contact sports of the martial arts. Andujar teaches a unitary member constructed of a foam base defining an opening and side slits into which a foot can be inserted. Also, a bottom or sole member is glued to the upper. The sole member has a heel opening and a ball of foot opening and is constructed of nylon-reinforced vinyl.

Rhee (U.S. Pat. No. 3,949,493) teaches a protective shoe adapted to protect the foot of the wearer for use in karate, kung fu, etc. The shoe is constructed of a casing containing an energy-absorbent soft resilient material. The shoe is substantially open at the bottom. The bottom of the shoe comprises a retaining means along the bottom of the shoe. The retaining means includes a peripheral rim, a cross medial portion and two toe portions.

While the related art teaches various forms of articles of footwear with anterior openings, there are many shortcomings. The prior art does not teach pads on either the lateral or medial side of the foot protection device. Also, the prior art does not teach a pad disposed along the malleolus of the ankle (on either the lateral or medial sides). Furthermore, the prior art does not teach an anterior opening that is sufficiently wide. There is a need in the art for an article of footwear that includes additional pads to help prevent injury. Additionally, there is a need in the art for footwear that includes a larger anterior opening to increase the surface area of the foot that is in contact with the ground and can provide better feel, thus helping the wearer achieve greater balance.

SUMMARY OF THE INVENTION

An article of footwear for use with contact sports is disclosed. In one aspect, the invention provides an article of footwear, comprising: a base portion including at least one pad; the base portion including a medial side and a lateral side; and where a first medial pad is disposed along the medial side and a first lateral pad is disposed along the lateral side.

In another aspect, the first medial pad and the first lateral pad are attached to the base portion via stitching.

In another aspect, the base portion is made of an elastic material.

In another aspect, a second lateral pad is disposed along the lateral side.

In another aspect, the base portion includes at least one pad associated with a medial malleolus of a user's foot.

In another aspect, the base portion includes an anterior opening disposed along a bottom portion of the footwear having a width greater than or equal to the a first width associated with the arch portion and greater than or equal to a second width associated with the toe portion and wherein a portion of the anterior opening is disposed along the medial side.

In another aspect, the invention provides an article of footwear, comprising: a base portion including at least one pad; a first region associated with a medial malleolus of a user's foot; and where the at least one pad is disposed along the first region.

In another aspect, the base portion is constructed of an elastic material.

In another aspect, a second region is associated with a lateral malleolus of the user's foot.

In another aspect, the base portion includes a medial side and a lateral side and wherein a first medial pad is disposed along the medial side and a first lateral pad is disposed along the lateral side.

In another aspect, the base portion includes an anterior opening disposed along a bottom portion of the footwear having a width greater than or equal to the a first width associated with the arch portion and greater than or equal to a second width associated with the toe portion and wherein a portion of the anterior opening is disposed along the medial side.

In another aspect, a heel portion of the base portion includes a posterior opening.

In another aspect, a toe portion of the base portion includes a set of toe holes.

In another aspect, the invention provides an article of footwear, comprising: a base portion including an anterior opening disposed along a bottom portion of the footwear; the bottom side of the footwear including an arch portion and a toe portion; the anterior opening having a first width, the arch portion having a second width and the toe portion having a third width; and where the first width is greater than or equal to the second width and the third width.

In another aspect, the base portion includes at least one pad associated with a medial malleolus of a user's foot.

In another aspect, a portion of the anterior opening is disposed along the medial side.

In another aspect, the base portion includes a medial side and a lateral side and wherein a first medial pad is disposed along the medial side and a first lateral pad is disposed along the lateral side.

In another aspect, the heel portion includes a posterior opening.

In another aspect, the toe portion includes a set of toe holes.

In another aspect, a fastening device is disposed along an ankle portion.

In another aspect, the invention provides an article of footwear, comprising: a base portion including a medial side and a bottom side; an anterior opening including an outer periphery; and where a first portion of the outer periphery is disposed along the bottom side and a second portion of the outer periphery is disposed along the medial side.

In another aspect, the base portion is constructed of an elastic material.

In another aspect, the base portion includes at least one pad associated with a medial malleolus of a user's foot.

In another aspect, the base portion includes a medial side and a lateral side and wherein a first medial pad is disposed along the medial side and a first lateral pad is disposed along the lateral side.

In another aspect, a heel portion of the base portion includes a posterior opening.

In another aspect, a toe portion of the base portion includes a set of toe holes.

In another aspect, the anterior opening is wider than the toe portion and the anterior opening is wider than the arch portion.

In another aspect, the invention provides an article of footwear, comprising: a base portion including a medial side and a lateral side; a first medial pad disposed along the medial side and a first lateral pad disposed along the lateral side; a first region associated with a medial malleolus of a user's foot; at least one pad being disposed along the first region; a base portion including an anterior opening disposed along a bottom portion of the footwear; the bottom side of the footwear including an arch portion and a toe portion; the anterior opening having a first width, the arch portion having a second width and the toe portion having a third width; and where the first width is greater than or equal to the second width and the third width and where the anterior opening includes an outer periphery and where a portion of the outer periphery is disposed along the medial side.

In another aspect, the base portion is made of an elastic material.

In another aspect, a second pad is disposed along a second region associated a lateral malleolus of the user's foot.

In another aspect, the base portion includes an ankle portion.

In another aspect, the ankle portion includes a fastening system.

In another aspect, the base portion includes a posterior opening.

Other systems, methods, features and advantages of the invention will be, or will become apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION OF THE PREFERRED EMBODIMENTS

Figure 1:
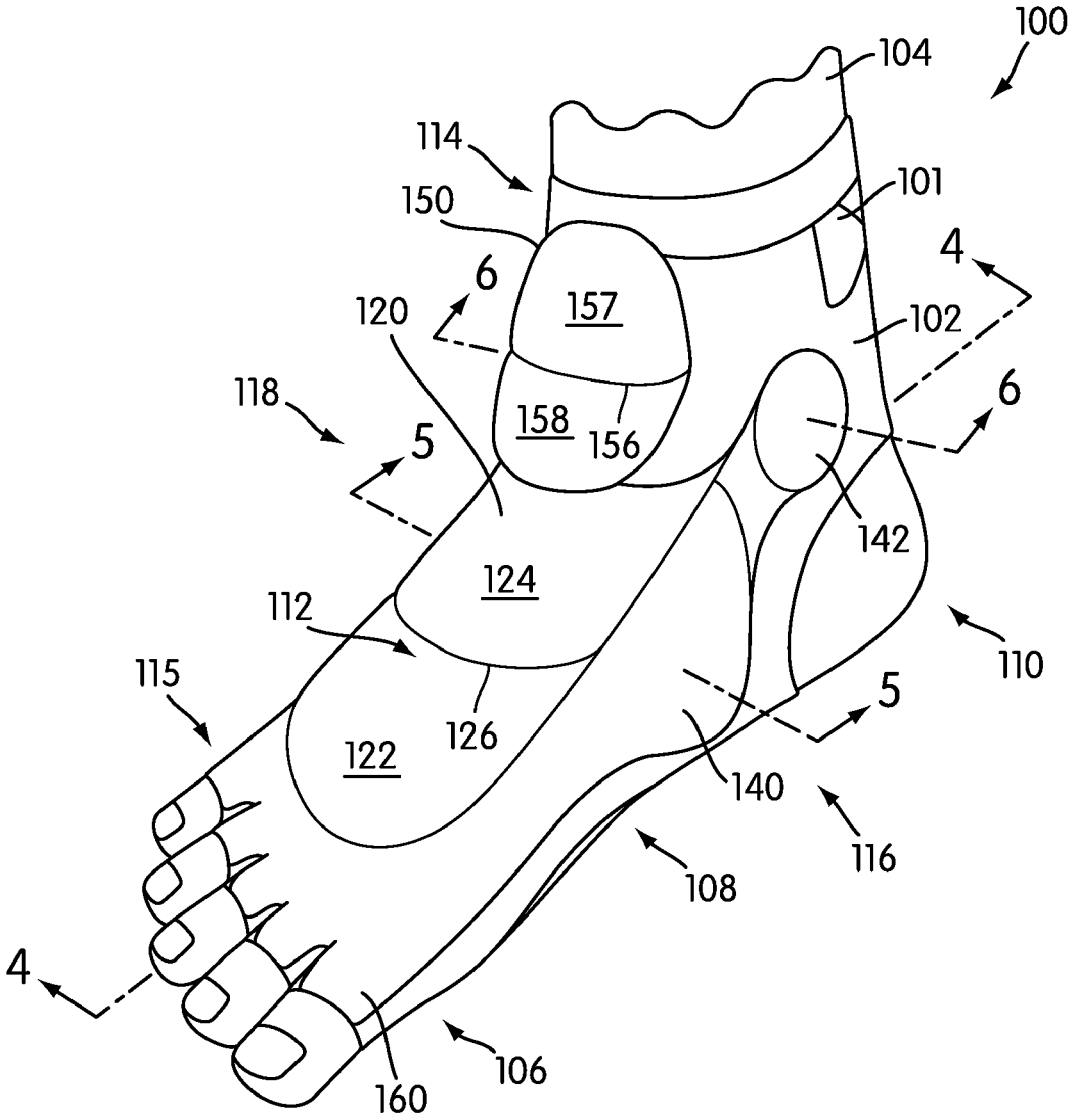
FIG. 1 is an isometric view of a preferred embodiment of an article of footwear.

FIG. 1 is an isometric view of a preferred embodiment of article of footwear 100. In a preferred embodiment, article of footwear 100 may be a Tae Kwon Do shoe. For clarity, the following detailed description discusses a preferred embodiment, however, it should be kept in mind that the present invention could also take the form of any other kind of footwear including, for example, other martial arts shoes, dance shoes, slippers, or any other kind of footwear.

Article of footwear 100 preferably includes base portion 102. Base portion 102 preferably covers a substantial majority of foot 104. In some embodiments, base portion 102 may be an elastic material. In a preferred embodiment, base portion 102 may be made from stretch Lycra.

In a preferred embodiment, base portion 102 may be constructed to be elastic and have a shape similar to that of a foot. In this manner, when worn, article of footwear 100 may cover foot 104 in a manner similar to that of a sock. In other words, base portion 102 may be taut against foot 104, retaining the general shape of foot 104.

Generally, article of footwear 100 may include multiple portions. In this embodiment, article of footwear 100 includes forefoot portion 106, arch portion 108 and heel portion 110. Additionally, article of footwear 100 may include instep portion 112, ankle portion 114 and toe portion 115. Article of footwear 100 may also include medial side 116 and lateral side 118.

In a preferred embodiment, article of footwear 100 may be associated with a second article of footwear that is constructed as the mirror image of article of footwear 100. In other words, the embodiment of article of footwear 100 shown in the figures is configured for a right foot, however a second article of footwear is preferably constructed to be worn on a left foot. It should be understood that the following detailed description of article of footwear 100 may also apply to this second article of footwear, and where the construction has an obvious left-right orientation, this orientation will be reversed for the second article of footwear.

Preferably, article of footwear 100 includes provisions for adjustably tightening ankle portion 114 to a wearer's ankle. In some embodiments, article of footwear 100 may include tab 101. Generally, tab 101 may be any device that allows ankle portion 114 to be tightened. In a preferred embodiment, tab 101 may include a hook or loop fastener that engages another cooperating hook or loop fastener disposed along base portion 102. This arrangement allows the wearer to adjust portion 114.

Figure 2:
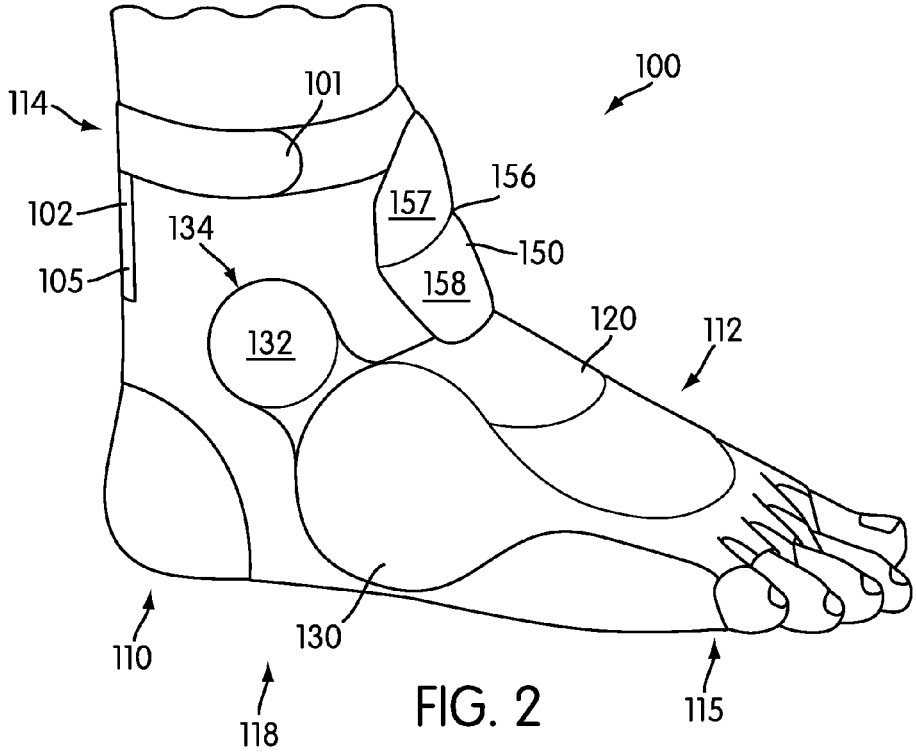
FIG. 2 is a side view of a preferred embodiment of an article of footwear.

Additionally, in some embodiments, base portion 102 may include split portion 105, as seen in FIG. 2. Preferably, split portion 105 is a region of base portion 102 where the material has been separated. Using this configuration, a user may more easily insert their foot into article of footwear 100, as split portion 105 may generally function to increase the opening through which the foot may be inserted.

Preferably, article of footwear 100 may include provisions that provide protection for various parts of foot 104. In some embodiments, article of footwear 100 may include one or more pads. In a preferred embodiment, article of footwear 100 may include pads associated with the instep, ankle and sides of foot 104, as well as the toes.

Figure 3:
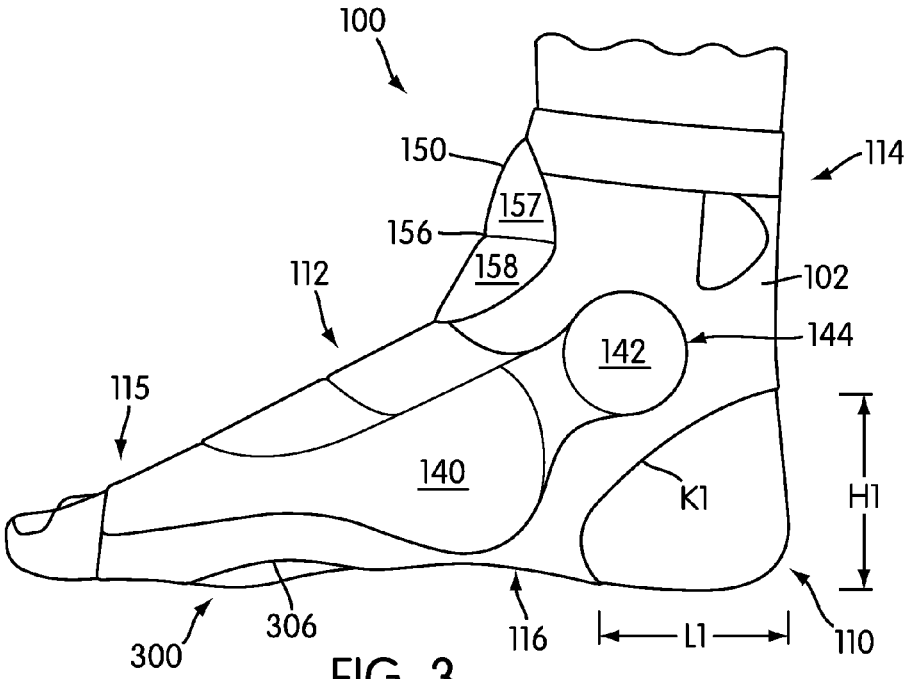
FIG. 3 is a side view of a preferred embodiment of an article of footwear.

Referring to FIGS. 1-3, article of footwear 100 preferably includes multiple pads. In some embodiments, instep portion 112 may include instep pad 120. Instep pad 120 preferably covers a majority of instep portion 112. In some embodiments, instep pad 120 may be divided into lower pad 122 and upper pad 124. In a preferred embodiment, lower pad 122 and upper pad 124 comprise the same single pad, but are divided by stitching 126.

Article of footwear 100 also preferably includes first lateral pad 130 and second lateral pad 132. First lateral pad 130 and second lateral pad 132 are preferably disposed along lateral side 118. In some embodiments, first lateral pad 130 may extend from toe portion 115 to ankle portion 114. Preferably, second lateral pad 132 extends from first lateral pad 130 and covers first region 134 of ankle portion 114. First region 134 is preferably associated with, and protects, the lateral malleolus of foot 104.

In a similar manner, article of footwear 100 also preferably includes first medial pad 140 and second medial pad 142. First medial pad 140 and second medial pad 142 are preferably disposed along medial side 116. In some embodiments, first medial pad 140 may extend from toe portion 115 to ankle portion 114. Preferably, second medial pad 142 extends from first medial pad 140 and covers second region 144 of ankle portion 114. Second region 144 is preferably associated with, and protects, the medial malleolus of foot 104.

Figure 5:
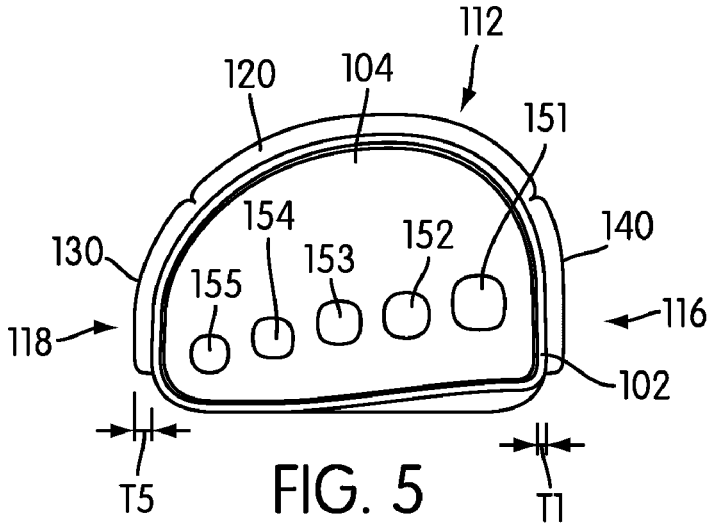
FIG. 5 is a cross sectional view of a preferred embodiment of an article of footwear.

Generally, instep portion 112 of article of footwear 100 may be associated with the instep of foot 104. The instep of foot 104 may include metatarsal bones 151, 152, 153, 154 and 155, as seen in FIG. 5. Using the configuration described above, instep pad 120 may be used to cushion the instep of foot 104, and in particular instep pad 120 may provide protection for metatarsal bones 151, 152, 153, 154 and 155. Therefore, the user of article of footwear 100 may perform various kicks and other athletic moves associated with martial arts, while protecting the instep portion of their foot.

In a preferred embodiment, medial side 116 and lateral side 118 of article of footwear 100 may be associated with the medial and lateral sides of foot 104. The medial and lateral sides of foot 104 may be associated with metatarsal bones 151 and 155, respectively. Using the configuration described above, first medial pad 140 and first lateral pad 130 may be used to cushion foot 104 along the medial and lateral sides of the foot, and in particular first medial pad 140 and first lateral pad 130 may provide cushioning to the outer metatarsal bones 151 and 155 respectively. This preferred pad arrangement allows the user of article of footwear 100 to perform various kicks and other athletic moves associated with martial arts, while protecting the medial and lateral sides of their foot from bruising or other injuries.

Figure 6:
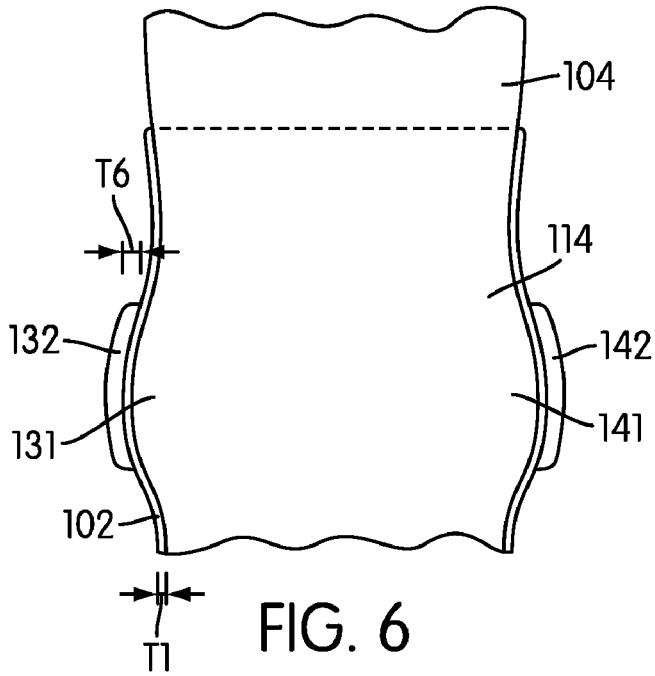
FIG. 6 is a cross sectional view of a preferred embodiment of an article of footwear.

Preferably, second medial pad 142 and second lateral pad 132 may be associated with ankle portion 114. As seen in FIG. 6, second medial pad 142 is preferably associated with medial malleolus 141 of foot 104, while second lateral pad 132 is preferably associated with lateral malleolus 131 of foot 104. Using this configuration, second medial pad 142 and second lateral pad 132 preferably provide cushioning to medial malleolus 141 and lateral malleolus 131. This configuration is preferable as both medial malleolus 141 and lateral malleolus 131 may be easily bruised due to their protruding anatomy.

In some embodiments, article of footwear 100 may include ankle pad 150. Preferably, ankle pad 150 may be associated with ankle portion 114 of article of footwear 100. Generally, ankle pad 150 may be attached directly to base portion 102 along ankle portion 114. In a preferred embodiment, ankle pad 150 may be attached via stitching. In a similar manner, each of the pads discussed in this embodiment are preferably attached via stitching to base portion 102. In other embodiments, each pad discussed in this detailed description may be attached to base portion 102 using an adhesive or another method of attachment.

Ankle pad 150 preferably includes upper pad 157 and lower pad 156. Preferably, upper pad 157 and lower pad 158 are joined at pivot 156. Pivot 156 may be a region of stitching, where upper pad 157 and lower pad 156 are attached together and/or to base portion 102. In some embodiments, ankle pad 150 may be made, or include a layer of, a synthetic leather.

Using this configuration, ankle pad 150 preferably provides cushioning to foot 104 along the front of the ankle. Additionally, with the use of pivot 156, ankle pad 150 may bend as foot 104 is pulled upwards, drawing instep portion 112 towards ankle portion 114. This may help to prevent undesirable stiffness along ankle portion 114 during use of article of footwear 100. This ankle pad arrangement helps to provide unrestricted motion of foot 104 with respect to motion at the ankle.

In some embodiments, article of footwear 100 may include toe pad 160, disposed along toe portion 115. In some embodiments, toe pad 160 may be constructed as a continuous extension of instep pad 120 as well as first medial pad 140 and first lateral pad 130. Toe pad 160 preferably extends over a small portion of the toes of foot 104. With this configuration, toe pad 160 may help to cushion portions of the toes of foot 104 during kicks or other athletic moves.

Preferably, instep pad 120, first medial pad 140, second medial pad 142, first lateral pad 130, second lateral pad 132, toe pad 160 and ankle pad 150 may be constructed of a similar material. In some embodiments, pads 120, 130, 132, 140, 142, 150 and 160 may be constructed of a pad material. In some embodiments, the pad material may be a type of foam. In a preferred embodiment, the pad material may be made of ethyl-vinyl-acetate (EVA) in a layered structure, with a soft EVA foam on the bottom (closer to the foot) and a harder EVA foam on top (farther from the foot). This preferred pad arrangement allows for increased dissipation of forces by the hard EVA foam, while the soft EVA foam that is disposed closer to the foot will provide more comfort to the wearer than in situations where the entire pad is made of a hard foam.

Generally, each of the pads 120, 130, 132, 140, 142, 150 and 160 may be raised from base portion 102. In some embodiments, base portion 102 may have a thickness T1, while the pads 120, 130, 132, 140, 142, 150 and 160 may have thicknesses different from thickness T1.

Figure 4:
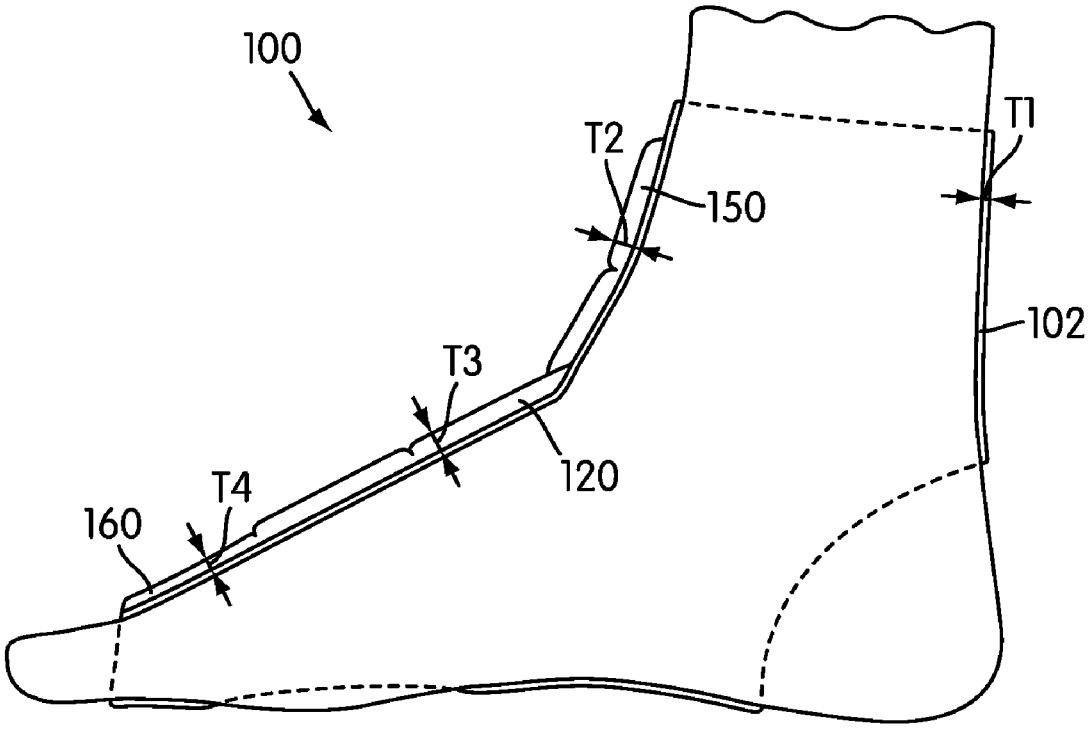
FIG. 4 is a cross sectional view of a preferred embodiment of an article of footwear.

It can be seen from FIGS. 4-6, that ankle pad 150 has thickness T2. Also, instep pad 120 has thickness T3 and toe pad 160 has thickness T4. First medial pad 140 and first lateral pad 130 have thickness T5. Finally, second medial pad 142 and second lateral pad 132 have thickness T6. Generally, thickness T1 is less than thicknesses T2-T6. Thicknesses T2-T6 may be varied in order to modify the amount of cushioning provided by pads 120, 130, 132, 140, 142, 150 and 160. Increasing the thicknesses of these pads may add support, but may also add unwanted bulk. Increased thickness may also inhibit motion. Generally, a balance may be found where the thickness of the pads is enough to provide the desired support without creating unwanted bulk or impairing motion.

Preferably, article of footwear 100 includes provisions for exposing various regions of the user's foot to the ground. In some embodiments, article of footwear 100 may include various openings. In a preferred embodiment, article of footwear 100 may include openings associated with the bottom of the foot, the heel of the foot and the toes of the foot. Preferably, the opening at the bottom of the foot may be wider than the base of the foot, exposing a substantial majority of the ball of the foot to the ground.

Figure 7:
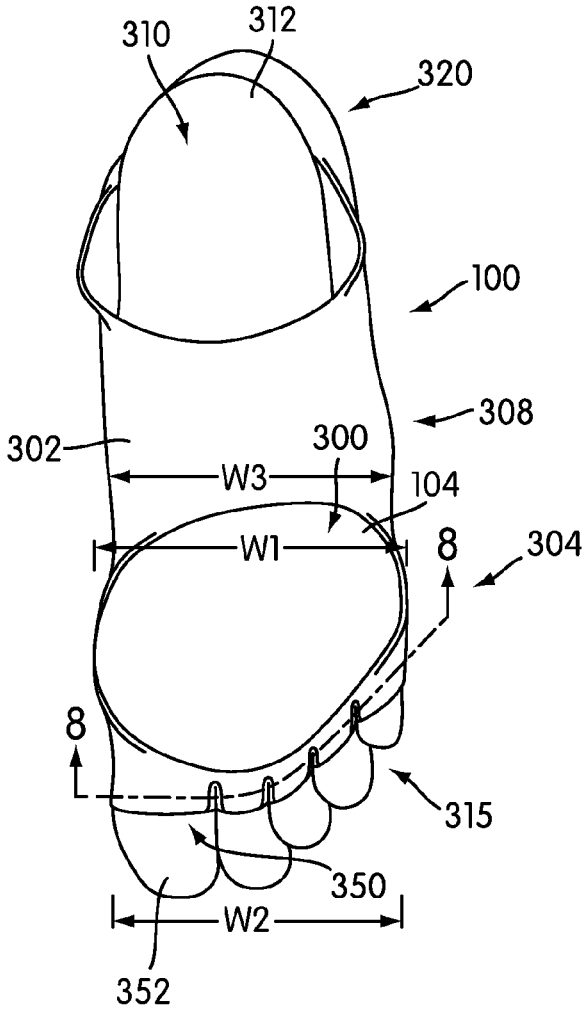
FIG. 7 is a bottom view of a preferred embodiment of an article of footwear.
Figure 8:
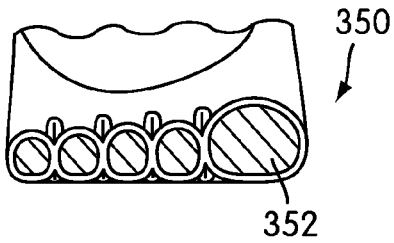
FIG. 8 is a cross sectional view of a preferred embodiment of an article of footwear.

Referring to FIG. 7, article of footwear 100 may include anterior opening 300. Anterior opening 300 may be disposed along bottom side 302 of article of footwear 100. In some embodiments, anterior opening 300 may be associated with first region 304 of foot 104. Preferably, first region 304 is the ball of foot 104, which is generally exposed to the ground.

Generally, the width of anterior opening 300 may be larger than the width of bottom side 302 of article of footwear 100. In this embodiment, anterior opening 300 has width W1. Although the width of bottom side 302 of article of footwear 100 varies over the length of foot 104, bottom side 302 may be characterized by width W2, along toe portion 315, and width W3, along arch portion 308. It is clear from FIG. 7, that width W1 of anterior opening 100 is larger than width W2 and width W3. In fact, medial edge 306 of anterior opening 300 preferably extends to medial side 116 of article of footwear 100, as seen in FIG. 3.

In a similar manner, article of footwear 100 preferably includes posterior opening 310. Posterior opening 310 is preferably disposed along heel portion 320 of article of footwear 100. In particular, heel 312 of foot 104 is preferably disposed through posterior opening 310. In this manner, heel 312 may be exposed to the ground.

Generally, the geometry of posterior opening 310 may be characterized by height H1, length L1 and opening curve K1 (as seen in FIG. 3). In some embodiments, L1 may be increased. This allows more of heel 312 to be exposed to the ground. In other embodiments, the value of H1 and the shape and size of curve K1 may also be varied.

In some embodiments, article of footwear 100 may also include toe holes 350. Preferably toe holes 350 may be associated with toes 352 of foot 104. In some embodiments, toes 352 may be disposed through toe holes 350. In this manner, toes 352 may be exposed to the ground.

Using this preferred configuration, the wearer of article of footwear 100 may retain the sense of being barefoot. As toes 352, first region 304 and heel 312 of foot 104 are all directly in contact with the ground, the wearer may maintain a proper sense of feel and balance that is necessary for athletic activities such as martial arts. In addition to allowing contact between these parts foot 104 and the ground, anterior opening 300, posterior opening 310 and toe holes 350 provide additional ventilation, which preferably reduces the tendency of foot 104 to overheat or perspire.

Figure 9:
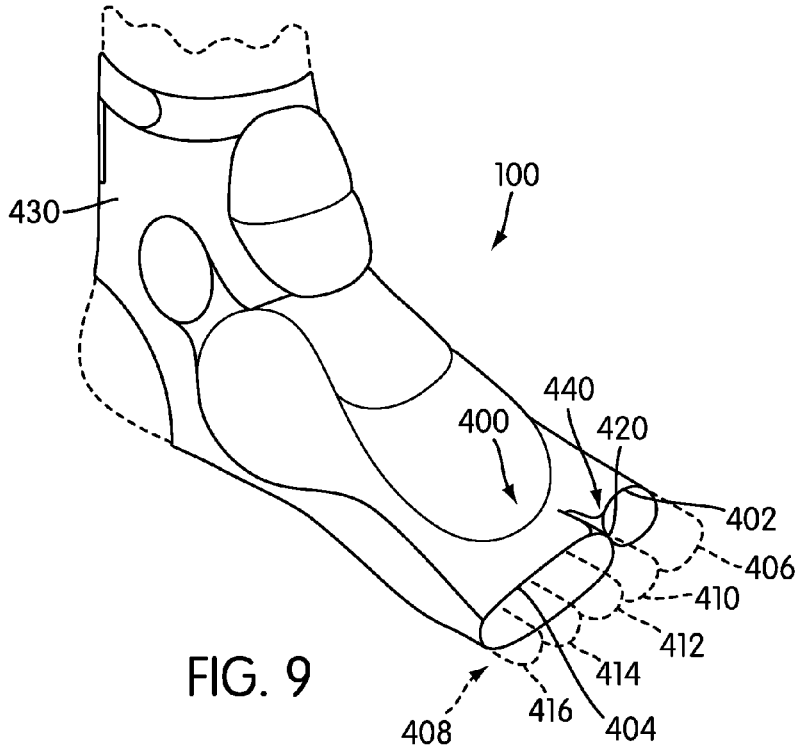
FIG. 9 is an isometric view of a preferred embodiment of an article of footwear.
Figure 10:
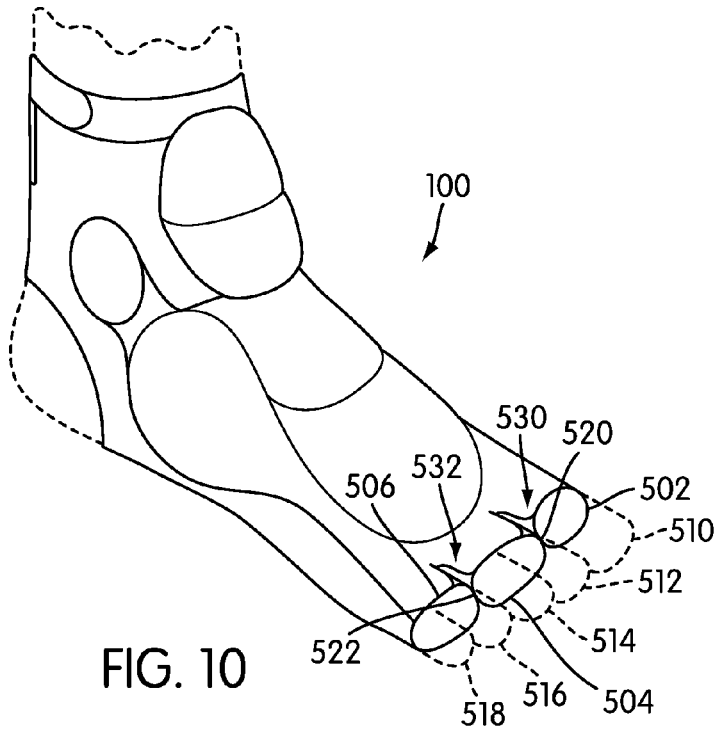
FIG. 10 is an isometric view of a preferred embodiment of an article of footwear.

In other embodiments, article of footwear 100 may not include toe holes for each toe. Instead, article of footwear 100 may be configured so that several toes are grouped together and associated with a single hole. Referring to FIG. 9, article of footwear 100 includes toe portion 400. Preferably, toe portion 400 is associated with first toe hole 402 and second toe hole 404. First (or big) toe 406 of foot 408, shown in phantom, may be associated with, and disposed through, first toe hole 402. Likewise, second toe 410, third toe 412, fourth toe 414 and fifth toe 416 may be associated with, and disposed through, second toe hole 404. In this embodiment, first separating portion 420 of base portion 430 preferably separates first toe hole 402 and second toe hole 404 and may also be associated with first region 440, disposed between first toe 406 and second toe 410.

This preferred toe configuration may increase the comfort of article of footwear 100, as toes 410, 412, 414 and 416 are free from interference associated with individual holes used for each toe. In other words, this toe configuration is preferably a natural configuration, as it increases the sensation of being barefoot, while still providing support for first toe 406.

In another embodiment, article of footwear 100 may include first toe hole 502, second toe hole 504 and third toe hole 506. Preferably, as with the previous embodiment, first toe hole 502 may be associated with first (or big) toe 510. In this embodiment, second hole 504 may be associated with second toe 512 and third toe 514. Finally, third toe hole 506 may be associated with fourth toe 516 and fifth toe 518. In this embodiment, first separating portion 520 and second separating portion 522 may be associated with first region 530 and second region 532. This alternative toe hole arrangement allows for a different type of support to toes 510, 512, 514, 516 and 518.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

We claim:

1. An article of footwear, comprising:

a base portion including at least one pad;

the base portion including a medial side and a lateral side; and wherein a first medial pad is disposed along the medial side and a first lateral pad is disposed along the lateral side, wherein the first medial pad is isolated along the medial side such that the first medial pad covers the base portion at an area corresponding to a protruding medial anatomy of a wearer's foot while keeping a remaining portion of the medial side of the base portion uncovered, wherein the first lateral pad is isolated along the lateral side such that the first lateral pad covers the base portion at an area corresponding to a protruding lateral anatomy of a wearer's foot while keeping a remaining portion of the lateral side of the base portion uncovered, and wherein the base portion includes an anterior opening disposed along a bottom portion of the footwear having a width greater than or equal to a first width associated with an arch portion and greater than or equal to a second width associated with a toe portion and wherein a portion of the anterior opening is disposed along the medial side.

2. The article of footwear according to claim 1, wherein the first medial pad and the first lateral pad are attached to the base portion via stitching.

3. The article of footwear according to claim 1, wherein the base portion is made of an elastic material.

4. The article of footwear according to claim 1, wherein a second lateral pad is disposed along the lateral side.

5. The article of footwear according to claim 1, wherein the base portion includes at least one pad associated with a medial malleolus of a user's foot.

6. An article of footwear, comprising:

a base portion including at least one pad;

a first region associated with a medial malleolus of a user's foot; and wherein the at least one pad is disposed along the first region, wherein the at least on pad is isolated on the base portion such that the at least one pad covers the medial malleolus of the user's foot while keeping a remaining portion of the base portion uncovered, and wherein the base portion includes an anterior opening disposed along a bottom portion of the footwear having a width greater than or equal to a first width associated with an arch portion and greater than or equal to a second width associated with a toe portion and wherein a portion of the anterior opening is disposed along a medial side.

7. The article of footwear according to claim 6, wherein the base portion is constructed of an elastic material.

8. The article of footwear according to claim 6, wherein a second region is associated with a lateral malleolus of the user's foot.

9. The article of footwear according to claim 6, wherein the base portion includes a medial side and a lateral side and wherein a first medial pad is disposed along the medial side and a first lateral pad is disposed along the lateral side.

10. The article of footwear according to claim 6, wherein a heel portion of the base portion includes a posterior opening.

11. The article of footwear according to claim 6, wherein a toe portion of the base portion includes a set of toe holes.

12. An article of footwear, comprising:

a base portion including an anterior opening disposed along a bottom portion of the footwear;

the bottom side of the footwear including an arch portion and a toe portion;

the anterior opening having a first width, the arch portion having a second width and the toe portion having a third width; and wherein the first width is greater than or equal to the second width and wherein the first width is also greater than or equal to the third width.

13. The article of footwear according to claim 12, wherein the base portion includes at least one pad associated with a medial malleolus of a user's foot.

14. The article of footwear according to claim 13, wherein a portion of the anterior opening is disposed along the medial side.

15. The article of footwear according to claim 12, wherein the base portion includes a medial side and a lateral side and wherein a first medial pad is disposed along the medial side and a first lateral pad is disposed along the lateral side.

16. The article of footwear according to claim 12, wherein the heel portion includes a posterior opening.

17. The article of footwear according to claim 12, wherein the toe portion includes a set of toe holes.

18. The article of footwear according to claim 12, wherein a fastening device is disposed along an ankle portion.

19. An article of footwear, comprising:

a base portion including a medial side and a bottom side;

an anterior opening including an outer periphery; and wherein a first portion of the outer periphery is disposed along the bottom side and a second portion of the outer periphery is disposed along the medial side.

20. The article of footwear according to claim 19, wherein the base portion is constructed of an elastic material.

21. The article of footwear according to claim 19, wherein the base portion includes at least one pad associated with a medial malleolus of a user's foot.

22. The article of footwear according to claim 21, wherein the base portion includes a medial side and a lateral side and wherein a first medial pad is disposed along the medial side and a first lateral pad is disposed along the lateral side.

23. The article of footwear according to claim 19, wherein a heel portion of the base portion includes a posterior opening.

24. The article of footwear according to claim 19, wherein a toe portion of the base portion includes a set of toe holes.

25. The article of footwear according to claim 24, wherein the anterior opening is wider than the toe portion and the anterior opening is wider than the arch portion.

26. An article of footwear, comprising:

a base portion including a medial side and a lateral side;

a first medial pad disposed along the medial side and a first lateral pad disposed along the lateral side;

a first region associated with a medial malleolus of a user's foot;

at least one pad being disposed along the first region;

a base portion including an anterior opening disposed along a bottom portion of the footwear;

the bottom side of the footwear including an arch portion and a toe portion;

the anterior opening having a first width, the arch portion having a second width and the toe portion having a third width; and wherein the first width is greater than or equal to the second width and the third width and wherein the anterior opening includes an outer periphery and wherein a portion of the outer periphery is disposed along the medial side.

27. The article of footwear according to claim 26 wherein the base portion is made of an elastic material.

28. The article of footwear according to claim 26 wherein a second pad is disposed along a second region associated with a lateral malleolus of the user's foot.

29. The article of footwear according to claim 26 wherein the base portion includes an ankle portion.

30. The article of footwear according to claim 29, wherein the ankle portion includes a fastening system.

31. The article of footwear according to claim 26, wherein the base portion includes a posterior opening.

* * * * *